United States Patent [19]

Bremner et al.

[11] Patent Number: 4,822,983

[45] Date of Patent: Apr. 18, 1989

[54] ELECTRICAL HEATERS

[75] Inventors: Robert Bremner, San Francisco; Hugh Duffy, Cupertino; Burton E. Miller, Sunnyvale, all of Calif.

[73] Assignee: Raychem Corporation, Menlo Park, Calif.

[21] Appl. No.: 938,659

[22] Filed: Dec. 5, 1986

[51] Int. Cl.[4] ..... H05B 1/02

[52] U.S. Cl. ..... 219/505; 219/504; 219/212; 219/509; 361/56; 361/91

[58] Field of Search ..... 219/212, 216, 505, 504, 219/507–509, 490, 491; 361/103, 55, 56, 91, 110, 110, 120

[56] References Cited

U.S. PATENT DOCUMENTS

| | | | |
|---|---|---|---|
| 2,581,212 | 1/1952 | Spooner et al. | 219/46 |
| 2,846,559 | 8/1958 | Rosenberg | 219/46 |
| 3,375,477 | 3/1968 | Kawazoe | 219/505 |
| 3,628,093 | 12/1971 | Crowley | 317/18 A |
| 4,436,986 | 3/1984 | Carlson | 219/505 |
| 4,439,801 | 3/1984 | Fajt | 219/5.05 |
| 4,575,620 | 3/1986 | Ishii et al. | 219/505 |
| 4,591,700 | 5/1986 | Sopory | 219/505 |
| 4,607,154 | 8/1986 | Mills | 219/505 |

*Primary Examiner*—M. H. Paschall

*Attorney, Agent, or Firm*—Timothy H. P. Richardson; Herbert G. Burkard

[57] ABSTRACT

Apparatus for automatically disconnecting a conductive polymer heater if an arcing fault occurs. A sensor conductor is incorporated into the heater, so that if an arcing fault occurs, the current through the sensor conductor increases and triggers a safety circuit to disconnect the heater. The sensor conductor is preferably insulated by an organic polymer which pyrolyses if an arcing fault occurs and thus permits current to flow between the sensor conductor and an electrode of the heater.

47 Claims, 2 Drawing Sheets

ELECTRICAL HEATERS

BACKGROUND OF THE INVENTION

1. Field of the Invention

This invention relates to electrical heaters comprising conductive polymers.

2. Introduction to the Invention

Electrical heaters of many different kinds are well known. Some are series heaters, e.g. mineral insulated heating cables, and others are parallel heaters which comprise two (or more) electrodes, e.g. wires or metal foils, and at least one resistive heating element which is connected in parallel between the electrodes. In one important class of parallel heaters, the heating element comprises a conductive polymer composition; preferably at least a part of the conductive polymer composition exhibits PTC (positive temperature coefficient) behavior, i.e. a rapid increase in resistivity at a particular temperature or over a particular temperature range, so that the heater is self-regulating. The term "conductive polymer" is used herein to denote a composition comprising an organic polymer (this term being used to include polysiloxanes) and, distributed therein, a particulate conductive filler. The term "switching temperature" or "$T_s$" is used herein to denote the temperature at which the rapid increase in resistivity of a PTC composition takes place. When the increase takes place over a temperature range, as is usually the case, $T_s$ is defined as the temperature at which extensions of the substantially straight portions of the plot of the log of the resistivity against temperature (above and below the range) cross. Conductive polymers, and heaters comprising them are disclosed, for example, in U.S. Pat. Nos. 3,861,029, 4,072,848, 4,177,446, 4,242,573, 4,246,468, 4,271,350, 4,272,471, 4,309,596, 4,309,597, 4,334,351, 4,421,582, 4,426,339, 4,429,216, 4,436,986, 4,459,473, 4,520,417, 4,543,774, 4,547,659, and 4,582,983, and in copending, commonly assigned U.S. application Ser. Nos. 720,117 (MP0922-US2), 780,524 (MP0897-US3), 787,218, 818,844 and 864,930 (MP1090-US1, 2 and 3), 818,845 (MP1095-US1) and 818,846 (MP1100-US1). The disclosure of each of the patents and applications listed above is incorporated herein by reference.

A problem which arises with all heaters is that if the heating element or one of the electrodes is broken, or if there is a short between the electrodes, for example as a result of the presence of water (or other conductive liquid), this can cause an arc fault which can have serious consequences, including initiation of a fire. The currents produced in the electrodes by an arcing fault are not necessarily such as to blow the fuse or circuit breaker through which the heater is connected to the power supply.

One use for self-regulating conductive polymer strip heaters is in electric blankets, and U.S. Pat. No. 4,436,986 (Carlson) proposes a safety circuit for such use which is intended to disconnect the heater if a break occurs in one of the electrodes, and thus to prevent ignition of the conductive polymer as a result of arcing at the break. The circuit requires electrical connection to be made at each end of the heater and makes use of a safety circuit which comprises at least one gas tube and which senses the voltage changes produced by an open circuit in one of the electrodes.

It is also known to provide a conductive polymer heater with a grounding plane, e.g. a metal braid around a strip heater or a metal plate on one or both sides of a sheet heater, and to connect the electrodes to a power supply through a ground fault equipment protective device (GFEPD), i.e. a device which constantly compares the current entering the heater in one electrode and the current leaving the heater in the other electrode and which disconnects the heater if the ratio between the currents differs from unity by some preselected amount. In this way, the heater is disconnected if physical damage to it causes one of the electrodes to become connected to ground. However, ground fault equipment protective devices are expensive, and do not operate at all unless the fault involves loss of current to a ground (or, more accurately, to any current sink). Thus they are of no use at all on non-grounded systems, and fail to detect faults, even on grounded systems, unless the arcing fault is accompanied by a ground fault.

SUMMARY OF THE INVENTION

We have discovered an improved way of automatically disconnecting a heater if it is subject to an arcing fault, thus substantially eliminating the danger that an arcing fault in a conductive polymer heater will cause a fire. This is achieved, according to the invention, by including in the heater a sensor conductor through which a first, relatively low, current (which may be zero) passes under normal operating conditions, and through which a second, relatively high, current passes if an arc fault occurs. The increase in current through the sensor conductor is used as a signal to a safety circuit which automatically disconnects the heater, and which preferably does not operate by comparing the currents in the two electrodes. The invention does not require electrical connections to be made at both ends of the heater, and thus preserves the valuable "cut-to-length" characteristic of parallel heaters; nor does it necessarily involve the delicate and expensive apparatus which is needed in order to compare currents, though, as explained below, a ground fault equipment protective device can be used, in a different circuit from that previously employed, in the present invention.

Thus in one simple embodiment of the invention, an insulated sensor wire is included in a strip heater. The far end of the sensor wire is insulated and the near end is connected to the gate of a triac which is connected between the leads to the heater. When an arc fault occurs, the insulation on the sensor wire is pyrolized and as a result current flows between the live electrode and the sensor wire; this current triggers the triac, shorting the leads from the power supply to the heater and blowing a fuse or circuit breaker in the live lead.

In one aspect, the present invention provides an electrical heating assembly which comprises (1) an electrical heater which comprises
- (a) two electrodes which can be connected to a source of electrical power;
- (b) a resistive heating element which is connected in parallel between the electrodes and which comprises a conductive polymer composition;
- (c) a sensor conductor;
- (d) a second conductor which is preferably one of the electrodes; and
- (e) an insulating element which
  - (i) insulates the sensor conductor from the second conductor at all temperatures up to 250° C., and (ii) if the heater is subject to an arcing fault, permits current to flow between the sensor conductor and the second conductor; and (2) an electrical safety system which, when the electrodes of the heater are connected to a suitable power source, (a) permits the electrodes to remain connected to the power source under normal operating conditions, (b) does not compare the currents in the electrodes, and (c) is connected to the sensor conductor so that if current flows between the sensor conductor and the second conductor, the heater is substantially disconnected from the power source.

In another aspect, the invention provides a heating assembly which comprises (1) a self-regulating electrical heater which comprises (a) two electrodes which can be connected to a source of electrical power;

(b) a resistive heating element which is connected in parallel between the electrodes and which comprises a conductive polymer composition exhibiting PTC behavior with a switching temperature $T_s$;

(c) a sensor conductor;

(d) a second conductor which is preferably one of the electrodes; and (e) an insulating element which (i) insulates the sensor conductor from the second conductor at all temperatures up to $(T_s+50)°$ C., and (ii) if the heater is subject to an arcing fault, permits current to flow between the sensor conductor and the second conductor; and (2) an electrical safety system which, when the electrodes of the heater are connected to a suitable power source, (a) permits the electrodes to remain connected to the power source under normal operating conditions, (b) does not compare the currents in the electrodes, and (c) is connected to the sensor conductor so that if current flows between the sensor conductor and the second conductor, the heater is substantially disconnected from the power source.

In another aspect, the present invention provides an electrical heating circuit which comprises (1) a power source;

(2) a heater which comprises (a) two electrodes which are connected to the power source, (b) a resistive heating element which is connected in parallel between the electrodes and which comprises a conductive polymer composition, and (c) a sensor conductor through which a first current passes so long as the conductive polymer composition is at a temperature of less than 250° C. and through which a second current passes if the heater is subject to an arcing fault, the second current being higher than the first current; and (3) an electrical safety system which (a) permits the heater to remain connected to the power source under normal operating conditions, (b) does not compare the currents in the electrodes, and (c) to which the sensor conductor is connected so that, when the second current passes through the conductor, the heater is substantially disconnected from the power source.

In another aspect the present invention provides an electrical heating assembly which comprises (1) an electrical heater which comprises (a) two electrodes which can be connected to a source of electrical power;

(b) a resistive heating element which is connected in parallel between the electrodes and which comprises a conductive polymer composition;

(c) a sensor conductor;

(d) a second conductor which is preferably one of the electrodes; and (e) an insulating element which (i) insulates the sensor conductor from the second conductor at all temperatures up to 250° C., and (ii) if the heater is subject to an arcing fault, permits current to flow between the sensor conductor and the second conductor; and (2) an electrical safety system which, when the electrodes of the heater are connected to a suitable power source, (a) permits the electrodes to remain connected to the power source under normal operating conditions, and (b) is connected to the sensor conductor so that if current flows between the sensor conductor and the second conductor, the heater is substantially disconnected from the power source;

subject to the proviso that the sensor conductor is not a continuous braid surrounding the heating element nor a metal sheet that is substantially coextensive with a laminar heating element.

In another aspect the present invention provides an electrical heating assembly which comprises (1) a self-regulating electrical heater which comprises (a) two electrodes which can be connected to a source of electrical power;

(b) a resistive heating element which is connected in parallel between the electrodes and which comprises a conductive polymer composition exhibiting PTC behavior with a switching temperature $T_s$;

(c) a sensor conductor;

(d) a second conductor which is preferably one of the electrodes; and (e) an insulating element which (i) insulates the sensor conductor from the second conductor at all temperatures up to $(T_s+50)°$ C., and (ii) if the heater is subject to an arcing fault, permits current to flow between the sensor conductor and the second conductor; and (2) an electrical safety system which, when the electrodes of the heater are connected to a suitable power source, (a) permits the electrodes to remain connected to the power source under normal operating conditions, and (b) is connected to the sensor conductor so that if current flows between the sensor conductor and the second conductor, the heater is substantially disconnected from the power source;

subject to the proviso that the sensor conductor is not a continuous braid surrounding the heating element nor a metal sheet that is substantially coextensive with a laminar heating element.

In another aspect the present invention provides an electrical heating circuit which comprises (1) a power source;

(2) a heater which comprises (a) two electrodes which can be connected to the power source, (b) a resistive heating element which is connected in parallel between the electrodes and which comprises a conductive polymer composition, and (c) a sensor conductor (i) which is not connected to a current sink, (ii) through which a first current passes so long as the conductive polymer composition is at a temperature of less than 250° C., and (iii) through which a second current passes if the heater is subject to an arcing fault, the second current being higher than the first current; and (3) an electrical safety system which permits the heater to remain connected to the power source under normal operating conditions and which is such that, when the second current passes through the conductor, the heater is substantially disconnected from the power source.

In another aspect the present invention provides an electrical heating circuit which comprises (1) a power source;

(2) a heater which comprises (a) two electrodes which are connected to the power source, (b) a resistive heating element which is connected in parallel between the electrodes and which comprises a conductive polymer composition exhibiting PTC behavior with a switching temperature $T_s$, and (c) a sensor conductor (i) which is not connected to a current sink, (ii) through which a first current passes so long as the conductive polymer composition is at a temperature of less than $(T_s+50)$° C., and (iii) through which a second current passes if the heater is subject to an arcing fault, the second current being higher than the first current; and (3) an electrical safety system which permits the heater to remain connected to the power source under normal operating conditions and which is such that, when the second current passes through the conductor, the heater is substantially disconnected from the power source.

BRIEF DESCRIPTION OF THE DRAWING

The invention is illustrated by the accompanying drawing, in which.

DETAILED DESCRIPTION OF THE INVENTION

Figure 1:
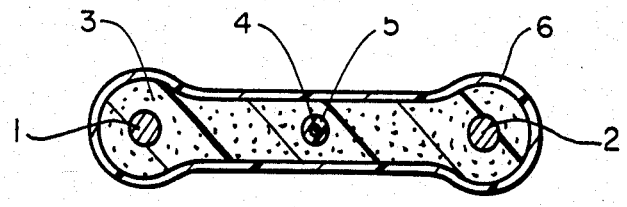
FIGS. 1–4 are diagrammatical cross-sections through heaters of the present invention.

The heating elements used in the present invention preferably comprise a conductive polymer composition which exhibits PTC behavior and thus renders the heater self-regulating. The heating element can comprise two or more different components, for example a layer of a PTC conductive polymer and one or more layers of a ZTC conductive polymer. The heater can comprise additional heating elements which are not composed of a conductive polymer, e.g. an inorganic layer which lies between a conductive polymer layer and a metal foil electrode. There can be a plurality of discrete heating elements, some or all of which comprise a conductive polymer, or a single continuous heating element (which can of course be regarded as a large number of contiguous heating elements). The heating element can comprise a continuous element which is composed of a conductive polymer and which makes continuous contact (either directly or through an intermediate layer composed of some other conductive material) with each of the electrodes. In one class of heaters, the electrodes are elongate metal wires or strips, and the resistive heating element comprises one or more continuous elements composed of a conductive polymer. In preferred heaters of this class, the heating elements are in the form of a continuous strip which is composed of a conductive polymer exhibiting PTC behavior and which has been prepared by melt-extruding the conductive polymer around the electrodes. In another class of heaters, the electrodes are laminar electrodes and the resistive element comprises one or more layers of conductive polymer which lie between the electrodes. In another class of heaters, the resistive elements comprise one or more layers of a conductive polymer and the electrodes are positioned in a staggered array so that part of the current flow between them is in the plane of the sheet.

The sensor conductor, which forms part of the heater and which in use is preferably connected to the safety system, preferably has the same general shape as the resistive heating element, so as to ensure a rapid response to an arcing fault in any part of the heater. Preferably the sensor conductor and the insulating element are such that if an arcing fault occurs at any location on the heater, electrical connection is made between the sensor conductor and another conductor, preferably one of the electrodes, substantially at that location. Thus if the heater is a strip heater, the sensor conductor is preferably a metal wire or strip which runs the length of the heater; and if the heater comprises one or more laminar resistive elements, the conductor is preferably a metal plate of substantially the same dimensions, or a metal wire or strip which has been coiled, e.g. in a serpentine shape, so that it has substantially the same dimensions as the resistive element.

In order that the current through the sensor conductor should reach a suitably high level when an arcing fault occurs it is preferably associated with a solid protective element which, when an arcing fault occurs, undergoes a change which reduces the impedance between the sensor conductor and the second conductor. On the other hand, the protective element should not undergo such a change under the normal operating conditions of the heater or indeed under any conditions which might accidentally arise in use but which do not involve an arcing fault. In this connection, it may be noted that this invention does not operate to disconnect the heater under the type of conventional overheating conditions which arise in the use of electric blankets, as for example as a result of covering the electric blanket by a conventional blanket, tucking the electric blanket under a mattress, or folding the electric blanket. It is known, in order to disconnect the blanket automatically if such overheating takes place, to incorporate in the blanket a sensor wire which is surrounded by a meltable material or an NTC material (i.e. one having a negative temperature coefficient of resistivity) and which forms part of a safety circuit, so that the melting of the material or its decrease in resistivity causes the current through the sensor wire to increase and trigger the safety circuit. Such systems are designed to operate at much lower temperatures than are generated by an arcing fault and are described for example in U.S. Pat. Nos 2,581,212, 2,846,559 and 3,628,093, the disclosures of which are incorporated herein by reference. Thus the protective element is generally one which does not undergo any substantial change, i.e. does not trigger the safety system, at temperatures up to 250° C. or even higher, e.g. 400° C. up to 500° C., but which does undergo a suitable change at the temperatures involved in an arcing fault, e.g. a temperature greater than 750° C. When, as is preferred, the conductive polymer exhibits PTC behavior with a switching temperature $T_s$, the protective element is preferably one which does not undergo any substantial change at temperatures up to $(T_s+50)$° C., preferably up to $(T_s+100)$° C.; such temperatures may of course be below or above 250° C., depending upon $T_s$. The protective element is preferably composed of an insulating material, particularly an organic polymer which undergoes pyrolysis when an arcing fault occurs, thus giving rise to electrically conductive carbonaceous residues. Suitable pyrolizable polymers (including polymers containing fillers such as fire retardants) are well-known, including polyvinyls, polyvinylidene halides, cellulosics, polyamides and aromatic polymers and other polymers which are susceptible to electrical tracking. So-called "magnet wire" is satisfactory for use in this invention. The sensor conductor preferably does not carry any current under normal operating conditions. However, it can carry a relatively small current, either as a result of the use of a protective element composed of a high resistivity conductive material, or because the sensor conductor is used to carry a current between its ends as part of a monitoring system, e.g. a continuity checking system.

The second conductor, to which the sensor conductor becomes connected (or better connected) when an arcing fault occurs, is preferably one of the electrodes of the heater, particularly the live electrode. However, the second conductor can also be one which serves no other purpose than to provide a current-carrying loop when the sensor conductor and the second conductor become connected.

The dimensions and positioning of the sensor conductor and the protective element (and of the second conductor if it is not one of the electrodes) should preferably be such as to minimize their effect on the electrical and physical characteristics of the heater. Thus if the heater is to be flexible, the sensor conductor is preferably placed at or near the bending axis of the heater. However, where the sensor conductor and protective element are placed within the conductive polymer, some redesign may be necessary to avoid changes in the performance of the heater.

The sensor conductor and the second conductor preferably form part of a safety system which, when a suitably high current passes through the sensor conductor, causes the heater to be substantially disconnected from the power source. The term "substantially disconnected" is used not only to include complete disconnection of the heater (as will occur for example when operation of the safety system includes blowing a fuse or opening a circuit breaker), but also to include reduction of the voltage applied to the heater and/or of the current through the heater to a low level which ensures that no further damage is done to the heater or its surroundings (as may occur for example when operation of the safety circuit includes conversion of a PTC circuit protection device from a low resistance to a very high resistance). Preferably the disconnection of the heater is such that no part of it remains at a potential which could cause an electrical shock to a user, or other damage.

Electrical safety systems of the kind used in this invention are well known in other, unrelated, contexts. Preferably the safety system comprises a triac or other thyristor, or a silicon-controlled rectifier (SCR), which is connected across the leads to the heater and to the gate of which the sensor conductor is connected. When a sufficiently large current flows through the sensor conductor, this triggers the thyristor, thus shorting the leads and resulting in a large current which blows a fuse or activates some other circuit protection system. It is also possible to use, in certain embodiments of the invention, a ground fault equipment protective device which compares the currents in the electrodes, the sensor conductor not being connected to a current sink, as the ground plane is in the known circuits containing a ground fault equipment protective device. When a self-regulating heater is used, the safety system should of course be such that it will not be triggered by the current inrush which takes place when the heater is first switched on.

This invention can be used in connection with the heating of any desired substrate, including a substrate which is not readily grounded or cannot be grounded, e.g. for heating polymeric piping systems and for heating substrates in trains, cars, trucks and airplanes.

Figure 2:
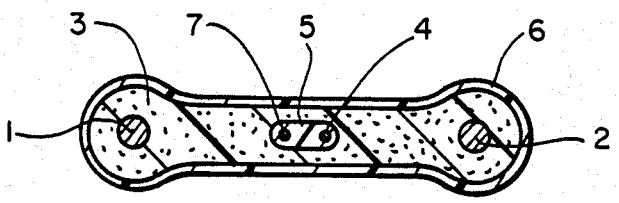
Figure 3:
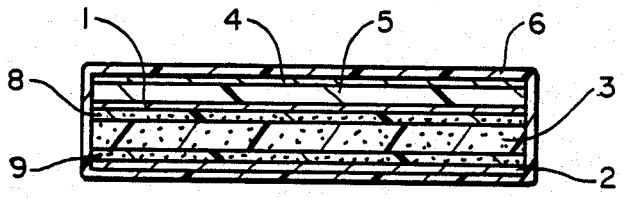
Figure 4:
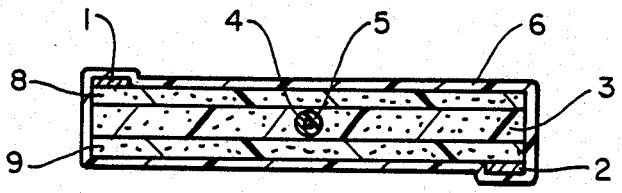

Referring now to the drawings, each of the FIGS. 1–4 shows electrodes 1 and 2, a continuous PTC conductive polymer heating element 3, a sensor conductor 4, an insulating element 5 around the sensor conductor 4, and an outer insulating jacket 6. The sensor conductor 4 and the insulating element 5 will in practice be of substantially smaller diameter than is shown in FIGS. 1–4. In FIGS. 1, 3 and 4 one (or both) of the electrodes acts as the second conductor to which sensor conductor 4 becomes connected when the conductive polymer burns. In FIG. 2, there is a separate second conductor 7. In FIGS. 3 and 4 the heating element also includes ZTC layers 8 and 9, which are shown as conductive polymers but which in FIG. 3 could be inorganic resistive layers on the electrodes 1 and 2.

Figure 5:
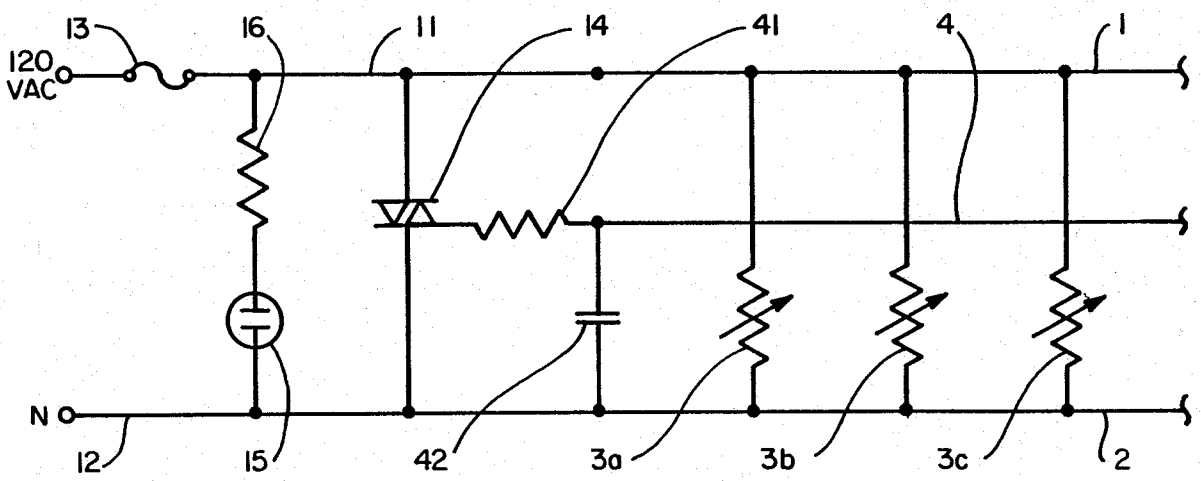
FIG. 5 is a circuit diagram of a heating system of the present invention.

FIG. 5 is a circuit diagram of a heating system of the invention. Electrodes 1 and 2 are connected via leads 11 and 12 to the phase and neutral poles respectively of a 120 volt AC power supply, with a fuse 13 in the live lead 11. The PTC heating element is represented by resistors 3*a*, 3*b* and 3*c*. A triac 14 is placed across the leads and the sensor conductor 4 is connected to the gate of the triac, via a resistor 41, and to the lead 12, via a capacitor 42. The resistor 41 and capacitor 42 function to absorb the current induced in the sensor conductor 4 when the system is first connected to the power supply and thus to prevent the triac from blowing prematurely. A neon lamp 15 and associated resistor 16 are also connected across the leads to show when the system is live.

We claim:

1. An electrical heating assembly which comprises (1) an electrical heater which comprises (a) two electrodes which can be connected to a source of electrical power;

(b) a resistive heating element which is connected in parallel between the electrodes and which comprises a conductive polymer composition;
(c) a sensor conductor;
(d) a second conductor; and
(e) an insulating element which
(i) insulates the sensor conductor from the second conductor at all temperatures up to 250° C., and
(ii) if the heater is subject to an arcing fault, permits current to flow between the sensor conductor and the second conductor; and
(2) an electrical safety system which, when the electrodes of the heater are connected to a suitable power source,
(a) permits the electrodes to remain connected to the power source under normal operating conditions,
(b) does not compare the currents in the electrodes, and
(c) is connected to the sensor conductor so that if current flows between the sensor conductor and the second conductor, the heater is substantially disconnected from the power source.

2. A heating assembly according to claim 1 wherein
(1) the second conductor is one of the electrodes;
(2) the sensor conductor and the insulating element are such that if an arcing fault occurs at any location on the heater, current flows between the sensor conductor and one of the electrodes substantially at that location; and
(3) the heating element is selected from the group consisting of
(a) an elongate strip prepared by melt extruding a conductive polymer composition exhibiting PTC behavior around two wire electrodes;
(b) a laminar element which has been prepared by melt-extruding a conductive polymer composition exhibiting PTC behavior and which lies between two laminar electrodes so that current flows through the laminar element substantially at right angles thereto; and
(c) a laminar element which has been prepared by melt-extruding a conductive polymer composition exhibiting PTC behavior and to which the electrodes are attached so that part of the current flow through the laminar element is in the plane thereof.

3. An assembly according to claim 1 wherein the insulating element is separated from each of the electrodes by at least part of the resistive element.

4. An assembly according to claim 3 wherein the heater is flexible and the sensor conductor is placed at or near the bending axis of the heater.

5. An assembly according to claim 1 wherein the insulating element insulates the sensor conductor at all temperatures up to 400° C.

6. An assembly according to claim 1 wherein the conductive polymer exhibits PTC behavior and the insulating element insulates the sensor conductor at all temperatures up to $(T_s+100)$° C., where $T_s$ is the switching temperature of the conductive polymer.

7. An electrical heating assembly which comprises
(1) a self-regulating electrical heater which comprises
(a) two electrodes which can be connected to a source of electrical power;
(b) a resistive heating element which is connected in parallel between the electrodes and which comprises a conductive polymer composition exhibiting PTC behavior with a switching temperature $T_s$;
(c) a sensor conductor;
(d) a second conductor; and
(e) an insulating element which
(i) insulates the sensor conductor from the second conductor at all temperatures up to $(T_s+50)$° C., and
(ii) if the heater is subject to an arcing fault, permits current to flow between the sensor conductor and the second conductor; and
(2) an electrical safety system which, when the electrodes of the heater are connected to a suitable power source,
(a) permits the electrodes to remain connected to the power source under normal operating conditions,
(b) does not compare the currents in the electrodes, and
(c) is connected to the sensor conductor so that if current flows between the sensor conductor and the second conductor, the heater is substantially disconnected from the power source.

8. A heating assembly according to claim 7 wherein
(1) the second conductor is one of the electrodes;
(2) the sensor conductor and the insulating element are such that if an arcing fault occurs at any location on the heater, electrical connection is made between the sensor conductor and one of the electrodes substantially at that location; and
(3) the heating element is selected from the group consisting of
(a) an elongate strip prepared by melt extruding a conductive polymer composition exhibiting PTC behavior around two wire electrodes;
(b) a laminar element which has been prepared by melt-extruding a conductive polymer composition exhibiting PTC behavior and which lies between two laminar electrodes so that current flows through the laminar element substantially at right angles thereto; and
(c) a laminar element which has been prepared by melt-extruding a conductive polymer composition exhibiting PTC behavior and to which the electrodes are attached so that part of the current flow through the laminar element is in the plane thereof.

9. An assembly according to claim 7 wherein the insulating element is separated from each of the electrodes by at least part of the resistive element.

10. An assembly according to claim 9 wherein the heater is flexible and the sensor conductor is placed at or near the bending axis of the heater.

11. An assembly according to claim 7 wherein the insulating element insulates the sensor conductor at all temperatures up to 400° C.

12. An electrical heating circuit which comprises
(1) a power source;
(2) a heater which comprises
(a) two electrodes which are connected to the power source,
(b) a resistive heating element which is connected in parallel between the electrodes and which comprises a conductive polymer composition, and
(c) a sensor conductor through which a first current passes so long as the conductive polymer composition is at a temperature of less than 250° C. and through which a second current passes if the heater is subject to an arcing fault, the second current being higher than the first current; and (3) an electrical safety system which (a) permits the heater to remain connected to the power source under normal operating conditions, (b) does not compare the currents in the electrodes, and (c) to which the sensor conductor is connected so that, when the second current passes through the conductor, the heater is substantially disconnected from the power source.

13. A circuit according to claim 12 wherein the insulating element is separated from each of the electrodes by at least part of the resistive element.

14. A circuit according to claim 13 wherein the heater is flexible and the sensor conductor is placed at or near the bending axis of the heater.

15. A circuit according to claim 12 wherein the insulating element insulates the sensor conductor at all temperatures up to 400° C.

16. A circuit according to claim 12 wherein the conductive polymer exhibits PTC behavior and the insulating element insulates the sensor conductor at all temperatures up to $(T_s+100)$° C., where $T_s$ is the switching temperature of the conductive polymer.

17. An electrical heating assembly which comprises (1) an electrical heater which comprises (a) two electrodes which can be connected to a source of electrical power;

(b) a resistive heating element which is connected in parallel between the electrodes and which comprises a conductive polymer composition;

(c) a sensor conductor;

(d) a second conductor; and (e) an insulating element which (i) insulates the sensor conductor from the second conductor at all temperatures up to 250° C., and (ii) if the heater is subject to an arcing fault, permits current to flow between the sensor conductor and the second conductor; and (2) an electrical safety system which, when the electrodes of the heater are connected to a suitable power source, (a) permits the electrodes to remain connected to the power source under normal operating conditions, and (b) is connected to the sensor conductor so that if current flows between the sensor conductor and the second conductor, the heater is substantially disconnected from the power source;

subject to the provision that the sensor conductor is not a continuous braid surrounding the heating element nor a metal sheet that is substantially coextensive with a laminar heating element.

18. A heating assembly according to claim 17 wherein (1) the second conductor is one of the electrodes; and (2) the heating element is an elongate strip prepared by melt-extruding a conductive polymer composition exhibiting PTC behavior around two wire electrodes, (3) the heater comprises an insulating jacket which surrounds and contacts the elongate strip, (4) the sensor conductor lies within the insulating jacket, and (5) the sensor conductor and the insulating element are such that if an arcing fault occurs at any location on the heater, current can flow between the sensor conductor and one of the electrodes substantially at that location.

19. An assembly according to claim 17 wherein the insulating element is separated from each of the electrodes by at least part of the resistive element.

20. A assembly according to claim 19 wherein the heater is flexible and the sensor conductor is placed at or near the bending axis of the heater.

21. An assembly according to claim 17 wherein the insulating element insulates the sensor conductor at all temperatures up to 400° C.

22. An assembly according to claim 17 wherein the conductive polymer exhibits PTC behavior and the insulating element insulates the sensor conductor at all temperatures up to $(T_s+100)$° C., where $T_s$ is the switching temperature of the conductive polymer.

23. An electrical heating assembly which comprises (1) a self-regulating electrical heater which comprises (a) two electrodes which can be connected to a source of electrical power;

(b) a resistive heating element which is connected in parallel between the electrodes and which comprises a conductive polymer composition exhibiting PTC behavior with a switching temperature $T_s$;

(c) a sensor conductor;

(d) a second conductor; and (e) an insulating element which (i) insulates the sensor conductor from the second conductor at all temperatures up to $(T_s+50)$° C., and (ii) if the heater is subject to an arcing fault, permits current to flow between the sensor conductor and the second conductor; and (2) an electrical safety system which, when the electrodes of the heater are connected to a suitable power source, (a) permits the electrodes to remain connected to the power source under normal operating conditions, and (b) is connected to the sensor conductor so that if current flows between the sensor conductor and the second conductor, the heater is substantially disconnected from the power source;

subject to the proviso that the sensor conductor is not a continuous braid surrounding the heating element nor a metal sheet that is substantially coextensive with a laminar heating element.

24. A heating assembly according to claim 23 wherein (1) the second conductor is one of the electrodes; and (2) the heating element is an elongate strip prepared by melt-extruding a conductive polymer composition exhibiting PTC behavior around two wire electrodes, (3) the heater comprises an insulating jacket which surrounds and contacts the elongate strip, and (4) the sensor conductor lies within the insulating jacket, and (5) the sensor conductor and the insulating element are such that if an arcing fault occurs at any location on the heater, current can flow between the sensor conductor and one of the electrodes substantially at that location.

25. An assembly according to claim 23 wherein the insulating element is separated from each of the electrodes by at least part of the resistive element.

26. An assembly according to claim 25 wherein the heater is flexible and the sensor conductor is placed at or near the bending axis of the heater.

27. An assembly according to claim 23 wherein the insulating element insulates the sensor conductor at all temperatures up to 400° C.

28. An assembly according to claim 23 wherein the insulating element insulates the sensor conductor at all temperatures up to $(T_s+100)$° C., where $T_s$ is the switching temperature of the conductive polymer.

29. An electrical circuit which comprises (1) a power source;

(2) a heater which comprises (a) two electrodes which can be connected to the power source, (b) a resistive heating element which is connected in parallel between the electrodes and which comprises a conductive polymer composition, and (c) a sensor conductor (i) which is not connected to a current sink, (ii) through which a first current passes so long as the conductive polymer composition is at a temperature of less than 250° C., and (iii) through which a second current passes if the heater is subject to an arcing fault, the second current being higher than the first current; and (3) an electrical safety system which permits the heater to remain connected to the power source under normal operating conditions and which is such that, when the second current passes through the conductor, the heater is substantially disconnected from the power source.

30. A heating circuit according to claim 29 which comprises an insulating element which is in the form of a coating of an organic polymer on the sensor conductor.

31. A heating circuit according to claim 30 wherein the heating element comprises a continuous element composed of a conductive polymer which exhibits PTC behavior with a switching temperature $T_s$.

32. A heating circuit according to claim 29 wherein the heating element has been prepared by melt extruding the conductive polymer composition around two wire electrodes and makes continuous contact with each of the electrodes, either directly or through another conductive material.

33. A heating circuit according to claim 32 wherein (a) the heater comprises an insulating jacket which surrounds and contacts the heating element and (b) the sensor conductor lies under the insulating jacket.

34. An heating circuit according to claim 29 wherein the electrodes are laminar electrodes and the heating element comprises a sheet which (a) lies between the electrodes and (b) is composed of a conductive polymer composition exhibiting PTC behavior.

35. A heating circuit according to claim 29 wherein the heating element comprises a sheet which is composed of a conductive polymer composition exhibiting PTC behavior and wherein the electrodes are positioned so that part of the current flow between them is in the plane of the sheet.

36. A heating circuit according to claim 29 wherein the sensor conductor is connected to the safety circuit and wherein the sensor conductor becomes connected to an electrode when the heater is subject to an arcing fault.

37. A heating circuit according to claim 29 wherein the sensor conductor and the insulating element are such that if an arcing fault occurs at any location on the heater, current flows between the sensor conductor and one of the electrodes substantially at that location.

38. A circuit according to claim 29 wherein the insulating element is separated from each of the electrodes by at least part of the resistive element.

39. A circuit according to claim 38 wherein the heater is flexible and the sensor conductor is placed at or near the bending axis of the heater.

40. A circuit according to claim 29 wherein the insulating element insulates the sensor conductor at all temperatures up to 400° C.

41. A circuit according to claim 31 wherein the insulating element insulates the sensor conductor at all temperatures up to $(T_s+100)$° C., where $T_s$ is the switching temperature of the conductive polymer.

42. An electrical heating circuit which comprises (1) a power source;

(2) a heater which comprises (a) two electrodes which are connected to the power source, (b) a resistive heating element which is connected in parallel between the electrodes and which comprises a conductive polymer composition exhibiting PTC behavior with a switching temperature $T_s$, and (c) a sensor conductor (i) which is not connected to a current sink, (ii) through which a first current passes so long as the conductive polymer composition is at a temperature of less than $(T_s+50)$° C., and (iii) through which a second current passes if the heater is subject to an arcing fault, the second current being higher than the first current; and (3) an electrical safety system which permits the heater to remain connected to the power source under normal operating conditions and which is such that, when the second current passes through the conductor, the heater is substantially disconnected from the power source.

43. A circuit according to claim 37 wherein (1) the second conductor is one of the electrodes;

(2) the sensor conductor and the insulating element are such that if an arcing fault occurs at any location on the heater, current flows between the sensor conductor and one of the electrodes substantially at that location; and (3) the heating element is selected from the group consisting of (a) an elongate strip prepared by melt extruding a conductive polymer composition exhibiting PTC behavior around two wire electrodes;

(b) a laminar element which has been prepared by melt-extruding a conductive polymer composition exhibiting PTC behavior and which lies between two laminar electrodes so that current flows through the laminar element substantially at right angles thereto; and (c) a laminar element which has been prepared by melt-extruding a conductive polymer composition exhibiting PTC behavior and to which the electrodes are attached so that part of the current flow through the laminar element is in the plane thereof.

44. A circuit according to claim 42 wherein the insulating element is separated from each of the electrodes by at least part of the resistive element.

45. A circuit according to claim 44 wherein the heater is flexible and the sensor conductor is placed at or near the bending axis of the heater.

46. A circuit according to claim 42 wherein the insulating element insulates the sensor conductor at all temperatures up to 400° C.

47. A circuit according to claim 42 wherein the insulating element insulates the sensor conductor at all temperatures up to $(T_s+100)$° C., where $T_s$ is the switching temperature of the conductive polymer.

* * * * *